US009359798B2

(12) United States Patent
Greenwood et al.

(10) Patent No.: US 9,359,798 B2
(45) Date of Patent: Jun. 7, 2016

(54) DOOR LATCH FOR ELECTRICAL EQUIPMENT ENCLOSURE

(75) Inventors: Peter James Greenwood, Cheshire, CT (US); Seth Adam Cutler, Middletown, CT (US); Maxime Pean, West Hartford, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 647 days.

(21) Appl. No.: 12/646,217

(22) Filed: Dec. 23, 2009

(65) Prior Publication Data

US 2011/0147387 A1 Jun. 23, 2011

(51) Int. Cl.

| | |
|---|---|
| ***B65D 45/16*** | (2006.01) |
| ***E05C 3/14*** | (2006.01) |
| ***E05B 17/20*** | (2006.01) |
| ***E05B 67/38*** | (2006.01) |
| *B65D 43/22* | (2006.01) |

(52) U.S. Cl.

CPC ..... *E05C 3/14* (2013.01); *E05B 17/2088* (2013.01); *E05B 67/383* (2013.01); *B65D 43/22* (2013.01); *Y10T 292/08* (2015.04); *Y10T 292/1043* (2015.04); *Y10T 292/1062* (2015.04)

(58) Field of Classification Search

CPC ..... E05C 3/14; E05B 67/383; E05B 17/2088; Y10T 292/1062; Y10T 292/08; Y10T 292/1043; B65D 43/22

USPC ..... 220/324, 326, 833, 834, 835; 292/95, 292/96, 99, 101, 121, 122, 128, 194, 219, 292/220, 228

See application file for complete search history.

(56) References Cited

U.S. PATENT DOCUMENTS

| | | | | | |
|---|---|---|---|---|---|
| 3,212,804 | A | * | 10/1965 | Hickey | 292/128 |
| 3,339,956 | A | * | 9/1967 | Bencene et al. | 292/127 |
| 3,451,702 | A | * | 6/1969 | Little | 292/99 |
| 4,074,091 | A | | 2/1978 | Bischof et al. | |
| 4,585,139 | A | * | 4/1986 | Bronson et al. | 220/833 |
| 5,927,766 | A | | 7/1999 | Rosen | |
| 6,357,804 | B1 | | 3/2002 | Bernier et al. | |
| 7,420,133 | B2 | | 9/2008 | Farrow et al. | |

* cited by examiner

*Primary Examiner* — James N Smalley
(74) *Attorney, Agent, or Firm* — GE Global Patent Operation; Stephen G. Midgley

(57) ABSTRACT

A latch for an electrical device enclosure, wherein the latch comprises a moveable member operable in response to high pressure conditions inside the enclosure, and is configured to prevent opening of the enclosure in the event of high pressure conditions inside the enclosure.

4 Claims, 6 Drawing Sheets

DOOR LATCH FOR ELECTRICAL EQUIPMENT ENCLOSURE

BACKGROUND OF THE INVENTION

1. Field of the Invention

The field of the present invention relates to a door latch for an electrical equipment enclosure generally, and more particularly to a door latch which can prevent the door of an electrical equipment enclosure from being forced open during a short circuit over current condition without requiring bolts within the latch, of which the following is a specification, reference being had to the drawings accompanying and forming a part of the same.

2. Description of the Related Art

In conventional electrical distribution and control systems, electrical switching devices are often enclosed in a housing having an openable cover or door. Conventional electrical equipment enclosures such as those containing, for example, a motor starter, electric switch, or circuit breaker require durable latches to prevent the enclosure door from blowing open under the arc gas pressure generated upon occurrence of a short-circuit overcurrent condition within any of the enclosed electric equipment.

In FIG. 1, a conventional switch device enclosure 100 is having a switching device (not shown), such as a circuit breaker or switch installed therein. A hinged cover or door 104 is openable via at least one hinge 133 to provide access to the interior of enclosure 100. When closed, the door 104 prevents direct operative access to the enclosed switch (not shown). An operating handle 102 mounted external to the enclosure 100 and movable in the directions indicated by arrow 119 is configured to drive a mechanism (not shown), which in turn acts to toggle the switch (not shown) from a power ON position to a power OFF position. Labels having text such as "ON" and "OFF", are positioned on enclosure 100 to correspond to operating handle 102 positions that likewise correspond to, and thus indicate, the state of the enclosed switch (not shown). The door 104 is retained in a closed position by at least one releasable door-latching mechanism 128 (FIG. 2A) having a releasable pawl or latch member 108 (FIG. 2A) comprising a tab 118 extending therefrom.

Referring to FIG. 2A, a cut-away side view of the interior of the enclosure of FIG. 1 is shown in the vicinity of the latch mechanism 128. A conventional latch member 108 is rotatably mounted to enclosure 100 by a rivet or pin 138 which provides an axis of rotation $A_1$ for latch 108. A center line $C_{L1}$ through the center axis of rotation pin 138 and generally orthogonal to the surface of door 104 is shown in FIG. 2A for reference. Latch member 108 comprises a tab 118 having a latching surface 119 configured to latchably cooperate with a latching portion 134 the outer surface of door 104. When enclosure door 104 is closed, an aperture or slot 114 disposed in the door 104 is configured to allow tab 118 to protrude through to the exterior of enclosure 100. To secure the door 104 in a closed position, a bias spring 120 is anchored between latch member 108 and enclosure 100 and disposed to apply a bias force $F_1$ in a first latching direction $D_1$ to maintain at least a portion of latching surface 119 proximal to a latching portion 134 of the outer surface of door 104. Generally, a small air gap 137 is provided between latching surface 119 and latching portion 134. The latching portion 134 of the outer surface of door 104 is conventionally disposed, with respect to the centerline $C_{L1}$ of the axis of rotation $A_1$, in first latching direction $D_1$. In this way, the latching surface 119 of tab 118 interferes with the surface of door 104 to prevent inadvertant opening of door 104.

To allow the door 104 to open, the latch member 108 is unlatched by manually applying a force $F_2$ to latch member 108 in a second de-latching direction $D_2$ generally opposite to the first latching direction $D_1$, sufficient to cause latch member 108 to rotate in a second de-latching direction $D_2$ around the axis of rotation $A_1$ and allow tab 118 to pass through slot 114.

Latch member 108 is provided with an aperture 112 configured to receive a locking member (not shown) such as the hasp of a lock (not shown) for locking the cover 104 closed.

As shown in FIG. 2B, in the event of a high-pressure condition in enclosure 100, for example, if the switching device (not shown) in the enclosure 100 experiences a short circuit fault, a relatively high instantaneous pressure is generated inside the enclosure 100. Under such a high internal pressure, a resultant expansive force vector $F_e$ is applied generally orthogonal to the enclosure door 104 which causes the door 104 to deflect or move in an outward direction. The door 104, at latching portion 134, in turn contacts the latching surface 119 of tab 118, thus applying the expansive force vector $F_e$ to tab 118. The latching surface 119 of tab 118 is conventionally configured to create a moment arm of length $R_1$ in the first latching direction D1, between the centerline $C_{L1}$ of the axis of rotation $A_1$ and the latching surface 119 of tab 118. It will be appreciated that, in the event of a high expansive force $F_e$ applied to the latching surface 119 in a direction generally orthogonal to the interior of enclosure door 104, a rotational force, or torque, $T_{R1}$, is developed in a second de-latching direction $D_2$, is applied to latch member 108 having a magnitude that is the product of the expansive force $F_e$ and moment arm $R_1$, such that $T_{R1}=F_e \times R_1$. The rotational force $T_{R1}$ biases the latch 108 in the second de-latching direction $D_2$, and, if of sufficient magnitude, for example greater than the force applied by bias spring 120, results in the rotation of latch 108.

As shown in FIG. 2C, and as discussed above, in the event of a high-pressure condition in enclosure 100, the conventional latch 108 may unlatch or move out of position, and allow the door 104 to open, thus releasing hot gasses and debris.

BRIEF SUMMARY OF THE INVENTION

In view of the foregoing, there is a need to provide a durable latch that is relatively simple in construction, using a minimum number of parts that prevents the enclosure door from opening during a short circuit fault. It would be desirable to provide a simple latch for an electrical equipment enclosure that increases the latching force exerted on the door in the event of a short circuit fault.

In an embodiment, an enclosure for mounting a switching device. The enclosure comprises a simple latch assembly that is configured to prevent opening of the enclosure in the event of high pressure conditions inside the enclosure.

In another embodiment, a latch for an enclosure having a door is provided. The latch comprises a moveable member operable in response to high pressure conditions inside the enclosure, and configured to prevent opening of the enclosure in the event of high pressure conditions inside the enclosure.

Other features and advantages of the disclosure will become apparent by reference to the following description taken in connection with the accompanying drawings.

BRIEF DESCRIPTION OF THE DRAWINGS

Although specific features of the invention are shown in some drawings and not in others, this is for convenience only as one or more of the features of any drawing may be combined with any or all of the other features of one or more of the remaining drawings in accordance with one or more embodiments of the invention.

The accompanying drawings, which are incorporated in and constitute a part of the specification, illustrate a presently preferred embodiment of the invention, in which.

DETAILED DESCRIPTION OF THE PREFERRED EMBODIMENTS

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Figure 1:
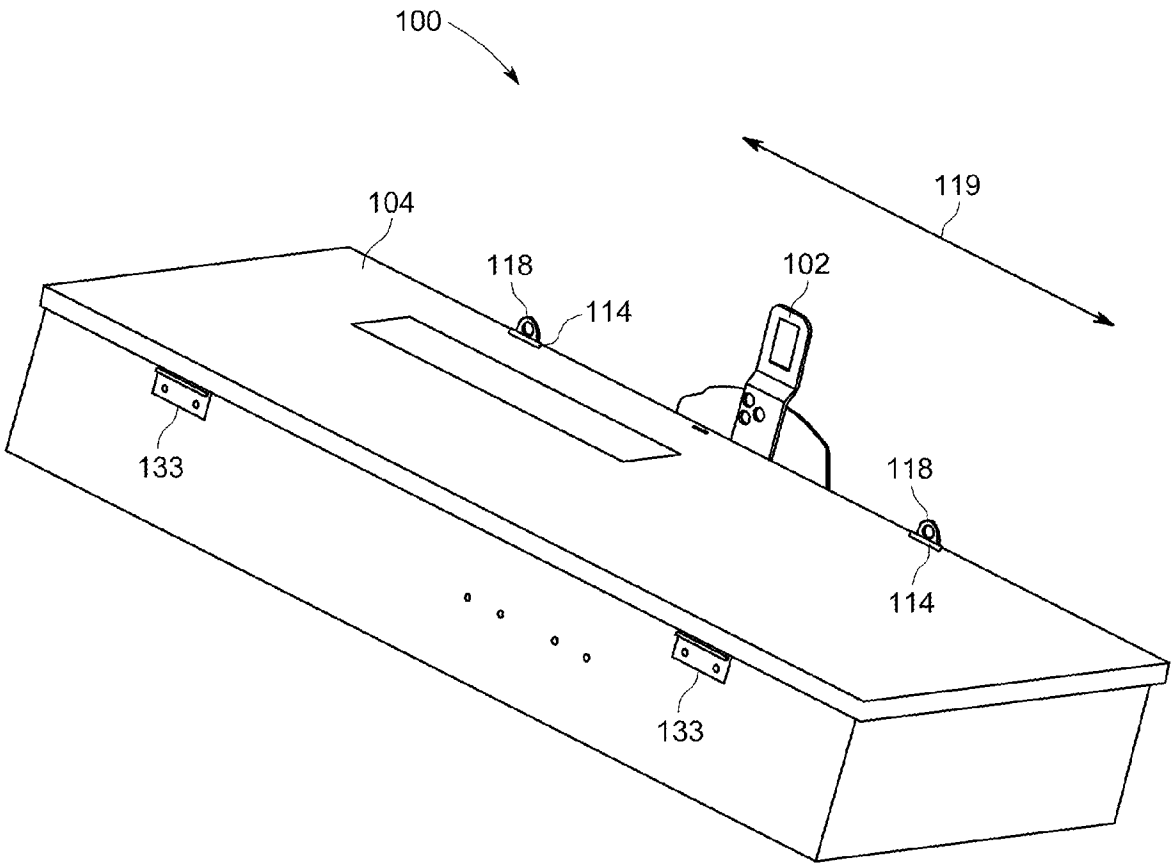
FIG. 1 (PRIOR ART)
FIG. 1 illustrates a perspective view of a prior art enclosure having a door secured by a conventional latch.
Figure 2B:
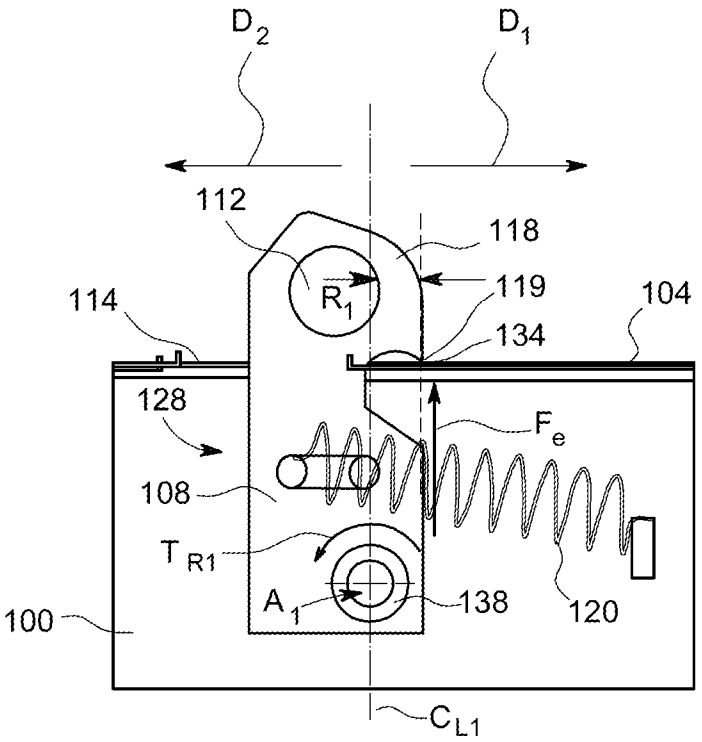
FIG. 2B (PRIOR ART)
FIG. 2B illustrates the forces applied to the prior art latch of FIG. 2A under a high-pressure condition.
Figure 2A:
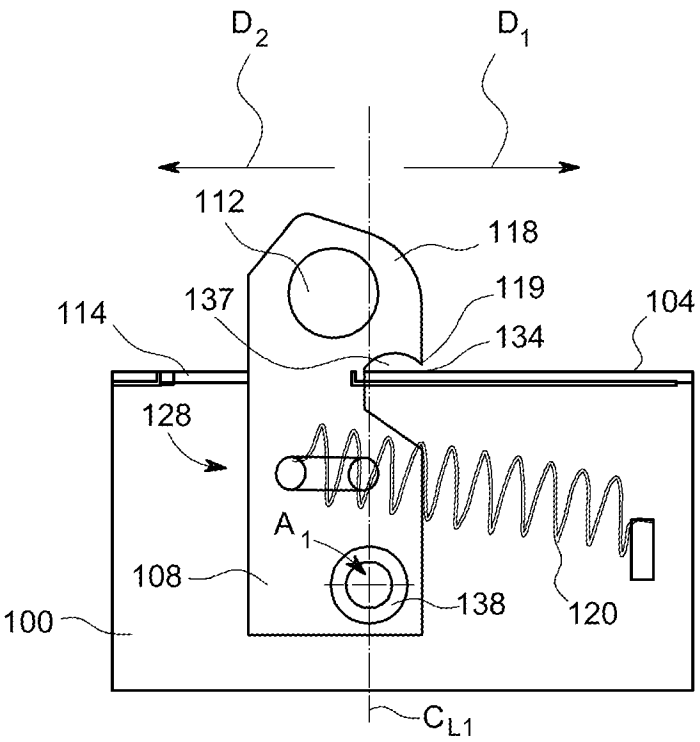
FIG. 2A (PRIOR ART)
FIG. 2A illustrates a side view of the prior art latch of FIG. 1 under a low-pressure condition.
Figure 2C:
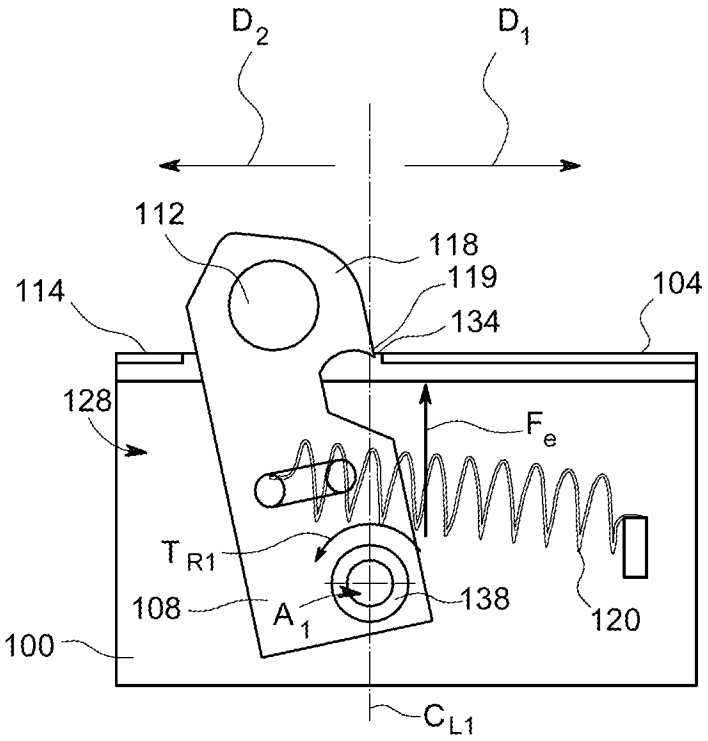
FIG. 2C (PRIOR ART)
FIG. 2C illustrates the prior art latch of FIG. 2B in an unlatched state.
Figure 3:
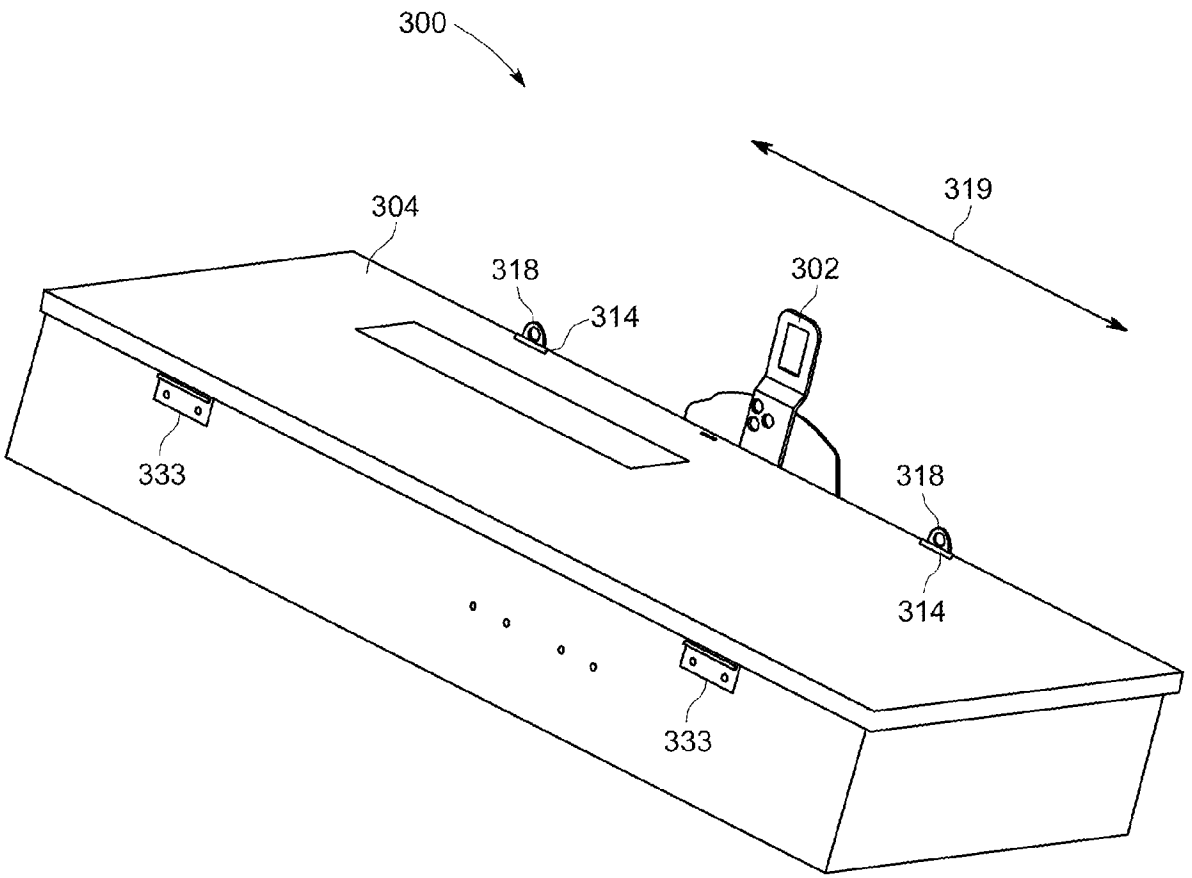
FIG. 3 illustrates a perspective view of an embodiment of an enclosure of the present invention.

In FIG. 3, a housing 300 configured to enclose a conventional switching device such as a conventional circuit breaker (not shown), installed therein is shown. A cover or door 304 having a first interior surface 354 and a second exterior surface 366 is openable to provide access to the interior of the housing 300. The door 304 is retained in a closed position by at least one releasable door-latching mechanism 328 having a biased releasable pawl or latch member 308 having a tab 318 extending therefrom.

Figure 4B:
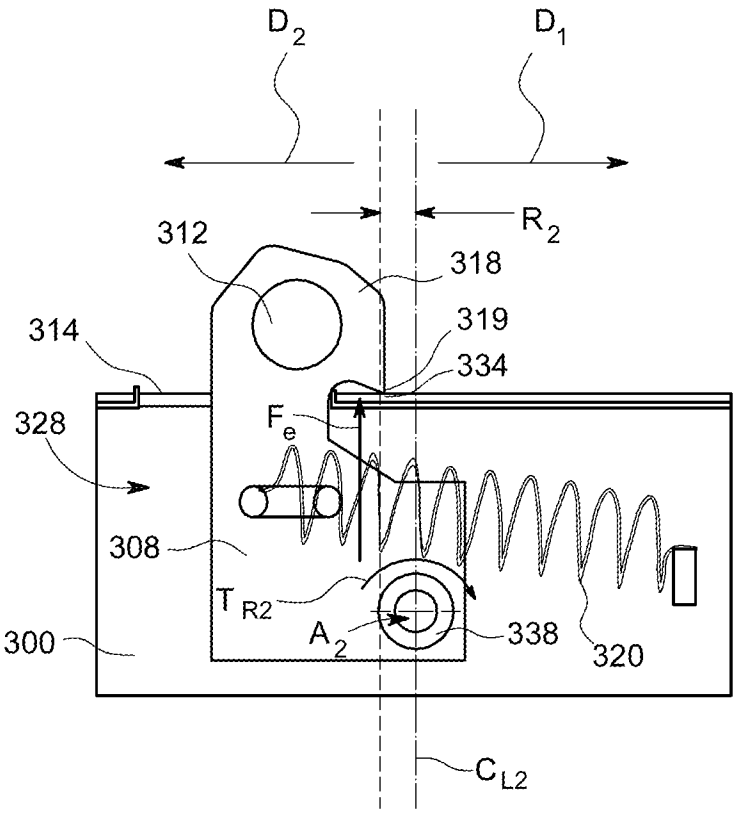
FIG. 4B illustrates the forces applied to the embodiment of FIG. 4A under a high-pressure condition.
Figure 4A:
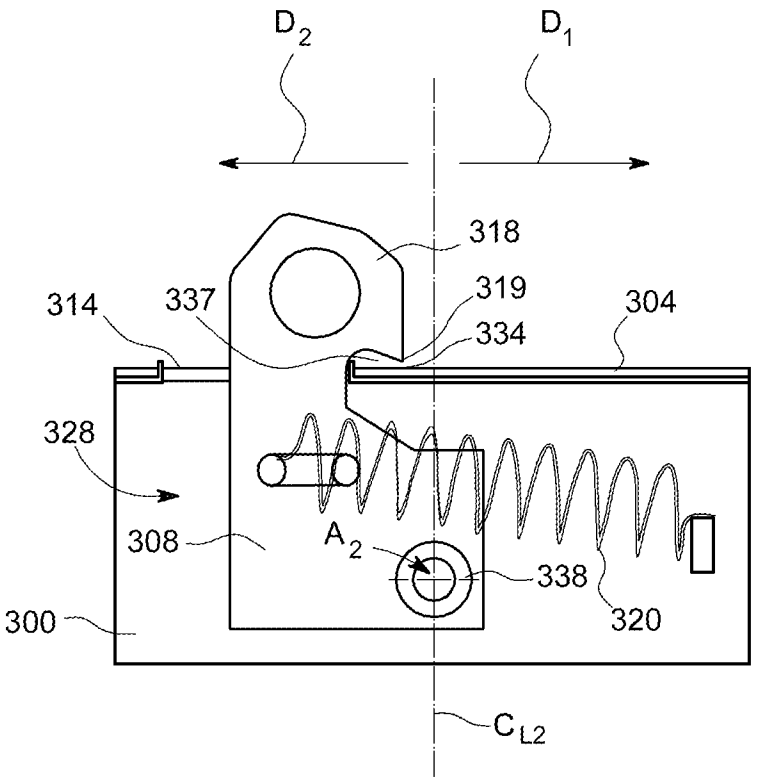
FIG. 4A illustrates a side view of an embodiment under a low-pressure condition.
Figure 4C:
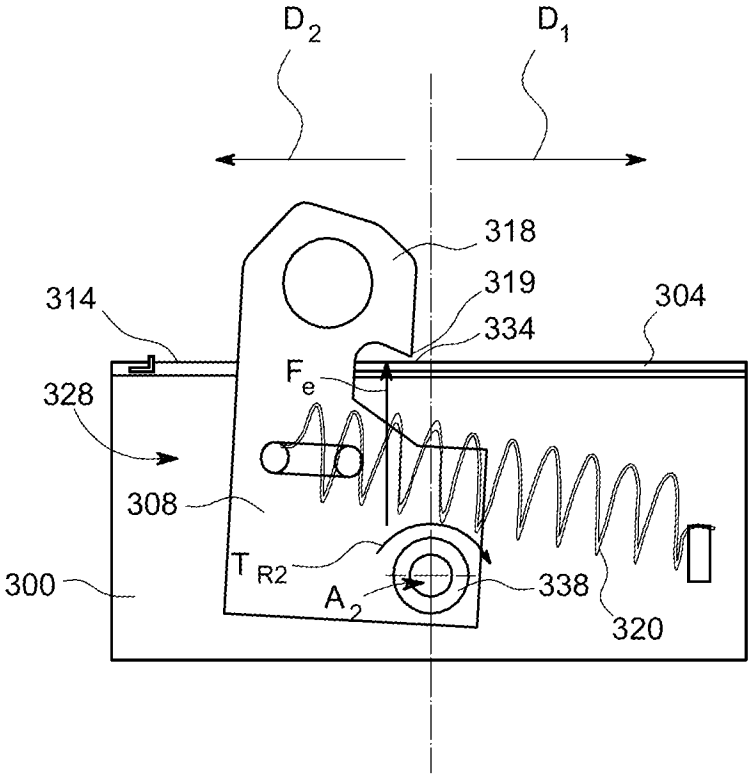
FIG. 4C illustrates embodiment of FIG. 4B in a fully latched state under the high-pressure condition of FIG. 4B.

As shown in FIG. 4A, a conventional latch member 308 is rotatably mounted to enclosure 300 by a rivet or pin 338 which provides an axis of rotation $A_2$ for latch 308. A center line $C_{L2}$ through the center axis of rotation pin 338 and generally orthogonal to the surface of door 304 is shown in FIG. 3A for reference. Latch member 308 comprises a tab 318 having a latching surface 319 configured to latchably cooperate with a latching portion 334 the outer surface of door 304. When enclosure door 304 is closed, an aperture or slot 314 disposed in the door 304 is configured to allow tab 318 to protrude through to the exterior of enclosure 300. To secure the door 304 in a closed position, a bias spring 320 is anchored between latch member 308 and enclosure 300 and disposed to apply a bias force $F_1$ in a first latching direction $D_1$ to maintain at least a portion of latching surface 319 proximal to a latching portion 334 of the outer surface of door 304. The latching portion 334 of the outer surface of door 304 is disposed, with respect to the centerline $C_{L2}$ of the axis of rotation $A_2$, in a second de-latching direction $D_2$ generally opposite to the first latching direction $D_1$. In this way, the latching surface 319 interferes with the opening of door 304.

To allow the door 304 to open, the latch member 308 is unlatched by manually applying a force $F_2$ in the second de-latching direction $D_2$, sufficient to overcome the biasing force of spring 320. The unlatching force $F_2$ rotates latch member 308 in the second de-latching direction $D_2$ around the axis of rotation $A_2$ and allows tab 318 to pass through slot 314.

As shown in FIG. 4B, in the event of a high-pressure condition in enclosure 300, if the switching device (not shown) in the enclosure 300 experiences a short circuit fault, a relatively high instantaneous pressure is generated inside the enclosure 300. Under such high internal pressure, an expansive force vector $F_e$ is applied generally orthogonal to the enclosure door 304 which causes the door 304 to deflect or move in an outward direction. The door 304, at latching portion 334, in turn contacts the latching surface 319 of tab 318, thus applying force vector $F_e$ to tab 318. The latching surface 319 of tab 318 is configured to create a moment arm of length $R_2$ in the second de-latching direction D2, between the centerline $C_{L2}$ of the axis of rotation $A_2$ and the latching surface 319 of tab 318. In the event of a high expansive force $F_e$ applied to the latching surface 319 in a direction generally orthogonal to the interior of enclosure door 304, a rotational force $T_{R2}$, is developed in the first latching direction $D_1$, is applied to latch member 308 having a magnitude that is the product of the expansive force $F_e$ and moment arm $R_2$, such that $T_{R2}=F_e \times R_2$. In this way, in the event of a high pressure condition, latch 308 acts to retain the door in a closed position With respect to the above description, it should be realized that the optimum dimensional relationships for the parts of the invention, to include variations in size, form function and manner of operation, assembly and use, are deemed readily apparent and illustrated in the drawings and described in the specification are intended to be encompassed only by the scope of appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope claims, or if they include equivalent structural elements with insubstantial differences from the literal languages of the claims.

What is claimed is:

1. An enclosure in which a high pressure condition may occur, the enclosure comprising:

a housing having an interior portion;

a cover coupled to said housing, having a surface comprising a latching portion and a cover aperture defined therethrough, said cover operable between a first closed position and a second open position;

a latch rotatably mounted to said housing and disposed to protrude through said cover aperture when said cover is in said first closed position;

said latch comprising an axis of rotation having a center line oriented orthogonally through said axis of rotation and generally orthogonal to the surface of said cover, said latch being rotatable in a first latching direction with respect to said center line to a first latched position, and rotatable in a second de-latching direction with respect to said center line generally opposite to the first latching direction, to a second de-latched position;

said latch further comprising a latching surface and configured to engage said latching portion of said cover to prevent movement of said cover from said first closed position to said second open position;

wherein said cover, when in said first closed position, is configured and disposed to convey a net first rotational force, in response to the high pressure condition, to said latch, the rotational force being in the first latching direction;

said latching portion of said cover disposed with respect to the centerline of the axis of rotation in said second delatching direction and to bias said latching portion toward said first latched position in response to the net first rotational force daring the high pressure condition.

2. The enclosure of claim 1 further comprising a spring, wherein said spring is configured and disposed to apply a second biasing force to the latch to further bias said latch toward said first latched position.

3. The enclosure of claim 1 wherein said axis comprises a pin, said pin being attached to said housing.

4. The enclosure of claim 1 wherein said latch is mounted on the interior of said housing.

* * * * *